US009428305B2

(12) United States Patent
Cenzano et al.

(10) Patent No.: US 9,428,305 B2
(45) Date of Patent: Aug. 30, 2016

(54) ENVELOPE SEAL STRIP

(71) Applicant: R.R. Donnelley & Sons Company, Chicago, IL (US)

(72) Inventors: Lauren Cenzano, N. Babylon, NY (US); Jessie Matthews, White Pine, TN (US); Rob Rosson, Irving, TX (US); Raymond R. Rivera, Chandler, AZ (US); Rosanna Perri, Repentigny (CA); Juliet Kenney, Brooklyn, NY (US)

(73) Assignee: R. R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 13/677,741

(22) Filed: Nov. 15, 2012

(65) Prior Publication Data

US 2013/0193195 A1 Aug. 1, 2013

Related U.S. Application Data

(60) Provisional application No. 61/560,198, filed on Nov. 15, 2011.

(51) Int. Cl.
*B65D 27/30* (2006.01)
*B65D 27/14* (2006.01)
(Continued)

(52) U.S. Cl.
CPC ..... *B65D 27/16* (2013.01); *B65D 27/14* (2013.01); *B65D 27/28* (2013.01)

(58) Field of Classification Search
CPC ..... B65D 33/1691
USPC ..... 229/79, 80, 76, 77, 80.5, 78.2, 300, 81; 383/89, 62
See application file for complete search history.

(56) References Cited

U.S. PATENT DOCUMENTS 913,987 A 3/1909 Simmons
2,088,232 A 7/1937 Cumming
(Continued)

FOREIGN PATENT DOCUMENTS

CN 2231655 Y 7/1996
CN 2383782 Y 6/2000
(Continued)

OTHER PUBLICATIONS

United States Patent and Trademark Office, "Notice of Allowance," issued in connection with U.S. Appl. No. 13/560,150, mailed on Jun. 6, 2014, 11 pages.
(Continued)

*Primary Examiner* — Jes F Pascua
*Assistant Examiner* — Derek Battisti
(74) *Attorney, Agent, or Firm* — Hanley, Flight & Zimmerman, LLC

(57) ABSTRACT

A sealing strip on a release layer is disclosed. The release layer can include an envelope with walls cooperatively enclosing a pocket with an opening. The envelope can include a closure flap pivotable to close the envelope. A first location of the envelope can include a sealing strip releasably adhered to the envelope (or a release layer on the envelope). This sealing strip can be removable from the first location and placeable in a second location overlapping the closure flap in the closed position and an adjacent portion of an envelope wall. The sealing strip can include an adhesive capable of adhering to the closure flap and adjacent portion of the second wall for securing the closure flap in the closed position. The sealing strip can include a removable grasping tab connected by a weakened area. The sealing strip can be provided on a release layer independent of an envelope.

20 Claims, 6 Drawing Sheets

(51) Int. Cl.

| | |
|---|---|
| ***B65D 27/12*** | (2006.01) |
| ***B65D 27/26*** | (2006.01) |
| ***B65D 27/06*** | (2006.01) |
| ***B65D 33/30*** | (2006.01) |
| ***B65D 33/16*** | (2006.01) |
| ***B65D 27/16*** | (2006.01) |
| ***B65D 27/28*** | (2006.01) |

(56) References Cited

U.S. PATENT DOCUMENTS

| | | | | |
|---|---|---|---|---|
| 2,367,440 | A | 1/1945 | Schieman | |
| 3,301,466 | A * | 1/1967 | Perino et al. | 383/41 |
| 3,702,171 | A * | 11/1972 | Levine | 229/79 |
| 4,008,851 | A | 2/1977 | Hirsch | |
| 4,066,167 | A * | 1/1978 | Hanna et al. | 383/204 |
| 4,402,453 | A * | 9/1983 | Regenstein, Jr. | 383/89 |
| 4,460,088 | A * | 7/1984 | Rugenstein et al. | 206/494 |
| 4,902,141 | A * | 2/1990 | Linnewiel | 383/61.1 |
| 4,911,563 | A * | 3/1990 | Ciani | 383/89 |
| 5,052,613 | A * | 10/1991 | Lin | 229/303 |
| 5,227,209 | A * | 7/1993 | Garland | 428/42.1 |
| 5,429,576 | A * | 7/1995 | Doderer-Winkler | 493/214 |
| 5,606,846 | A * | 3/1997 | Raby et al. | 53/415 |
| 5,855,434 | A * | 1/1999 | Hagen | 383/89 |
| 6,123,256 | A | 9/2000 | Landis | |
| 6,155,481 | A | 12/2000 | Rawlings | |
| 6,436,500 | B1 * | 8/2002 | Yingst et al. | 428/40.1 |
| 6,488,999 | B1 | 12/2002 | Flynn et al. | |
| 6,517,243 | B2 * | 2/2003 | Huffer et al. | 383/88 |
| 7,776,418 | B2 * | 8/2010 | Dance et al. | 428/40.1 |
| 8,851,360 | B2 * | 10/2014 | Cenzano | 229/79 |
| 2003/0044567 | A1 * | 3/2003 | Jevons | 428/77 |
| 2006/0231605 | A1 | 10/2006 | Collins | |
| 2010/0038414 | A1 * | 2/2010 | DeLaVergne | 229/305 |
| 2012/0061455 | A1 * | 3/2012 | Didato et al. | 229/80.5 |
| 2013/0119121 | A1 | 5/2013 | Cenzano | |

FOREIGN PATENT DOCUMENTS

| | | | |
|---|---|---|---|
| CN | 2679055 | Y | 2/2005 |
| CN | 102216968 | A | 10/2011 |
| JP | 2010083115 | A | 4/2010 |

OTHER PUBLICATIONS

United States Patent and Trademark Office, "Office Action," issued in connection with U.S. Appl. No. 13/560,150, mailed on Nov. 14, 2013, 12 pages.

Canadian Intellectual Property Office, "Office Action," issued in connection with Canadian Patent Application No. 2,795,657, mailed on Nov. 16, 2015, 6 pages.

State Intellectual Property Office of People's Republic of China, "The First Office Action," issued in connection with Chinese Patent Application No. 201210494872.9, dated Mar. 3, 2016, 9 pages.

Canadian Intellectual Property Office, "Office Action," issued in connection with Canadian Patent Application No. 2,795,656, mailed on Nov. 24, 2015, 4 pages.

* cited by examiner

ENVELOPE SEAL STRIP

CROSS-REFERENCE TO RELATED APPLICATIONS

This application claims priority to U.S. Provisional Application No. 61/560,198 filed Nov. 15, 2011. The entire disclosure of the above-referenced application is incorporated herein by reference in its entirety.

TECHNICAL FIELD

The present subject matter relates generally to a sealing strip that can be used with an envelope.

BACKGROUND

Known envelope flaps often have a moisture activated adhesive, but could also include a removable barrier over the adhesive (so called peal and stick), or any other included adhesive. Prior to the traditional adhesive strip, flaps were sealed with an external binding connected to both the flap and adjacent side to bind the flap closed. This binding could be melted wax or something similar. An affixable seal (e.g. a foil piece with adhesive included on one side), and/or a sticker type item has also been used to seal (or double seal in conjunction with included flap adhesive) envelope flaps. U.S. Pat. No. 2,367,440 describes a self-sealing paper envelope. Also, U.S. Pat. No. 5,429,576 describes a reusable adhesive envelope having a pressure sensitive adhesive, which is initially covered by a release liner. Upon removing the release liner the adhesive on the flap may be secured to the protective strip to close the flap, which may be opened and closed numerous times.

Traditional envelopes, particularly postal mailing envelopes, are configured to have a ship to and return to address printed on the envelope or affixed to the envelope (e.g., through an adhesive or a receiving window). Return addresses are often printed on pre-printed affixable labels, since unlike the ship to address, the return address text does not often change. By rule, these are typically affixed in a particular area (e.g., the upper left corner of the front side or center top of the reverse side).

Users of envelopes will sometimes double seal an envelope to ensure it does not open during transit, or otherwise increase the closure seal. A deficiency of the most common included adhesive, i.e., moisture activated adhesives, is that a heavy humidity, heat, or other environmental condition can weaken or even release the closure seal, thereby opening the envelope during transit. A user may apply some tape or a sticker across the flap and adjacent side in order to deter this deficiency of just the flap adhesive alone. U.S. Pat. No. 913,987 describes an envelope where projecting tongues adapted to fold over the sealing flap after the latter is folded and sealed, and thus firmly secure the sealing flap and prevent it from being opened. U.S. Pat. No. 3,702,171 describes an envelope with superimposed strips aligned to be partially lifted and placed back down on the flap to seal the envelope.

It is desirable to provide an improved sealing arrangement.

SUMMARY

In one embodiment, an envelope is provided that can have first and second walls that cooperatively enclose a pocket space and define therebetween an envelope opening to the pocket space. The envelope can include a closure flap pivotally associated with the first wall and pivotable to a closed position against the second wall. In the closed position, the closure flap can overlap the second wall in an area of overlap and can close the envelope opening. The envelope can include a sealing strip releasably adhered to the envelope in a first location outside of the area of overlap. The sealing strip can be removable from the first location and placeable in a second location in which it overlaps the closure flap in the closed position and an adjacent portion of the second wall. The sealing strip can include an adhesive capable of adhering to the closure flap and the adjacent portion of the second wall for securing the closure flap in the closed position, which can be permanent or temporary.

The exemplary envelope can also include a release layer on the first location configured for providing the releasable adhesion and allowing removal of the sealing strip. The sealing strip can include a tape with a layer of the adhesive. The sealing strip can also include a weakened region dividing the strip into a sealing portion and a grasping portion. The weakened region can be configured for facilitating manual separation of the sealing and grasping portions. The weakened area can include perforations, notches, or any number of other weakening features. The sealing strip can be provided on an envelope or separate from an envelope, e.g., on a base layer.

The weakened area can include a line of perforations extending across the strip of tape, and/or at least one notch on at least one lateral side of the adhesive strip arrangement. The exemplary notch can help initial a tear in the weakened area for removal of the grasping portion. The exemplary weakened area can be configured to hold the sealing and grasping portions together when pulled in a first direction, and configured for facilitating manual separation of the sealing and grasping portions when pulled in a second direction. The exemplary weakened region can be configured to hold the sealing and grasping portions together when the sealing strip is removed from the base layer, and further configured for facilitating manual separation of the sealing and grasping portions when the sealing portion is adhered to the another substrate.

The exemplary sealing strip can be a tape elongated in a longitudinal axis, and the weakened region can extend laterally across the tape. The exemplary grasping portion can be different in appearance than the sealing portion. This can include the grasping portion including instructions on how to remove the grasping portion from the sealing portion. Further, the exemplary sealing portion can include printed indicia on the side opposite the adhesive layer, such as a postal address or company logo.

The exemplary base layer can include a release layer configured for providing a low-adhesion with the adhesive layer thereby facilitating the releasably adhering the sealing portion to the base layer. This exemplary release layer can include a wax layer. The exemplary base layer can be sprayed onto the base layer substrate in certain exemplary embodiments, or applied in any other manner, e.g., any other automated manner. The base layer, and another substrate can form different parts of a common substrate (e.g., an envelope).

Additional advantages and novel features of the examples will be set forth in part in the description which follows, and in part will become apparent to those skilled in the art upon examination of the following description and the accompanying drawings or may be learned by production or operation of the examples. The advantages of the concepts may be realized and attained by means of the methodologies, instrumentalities and combinations particularly pointed out in the appended claims.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
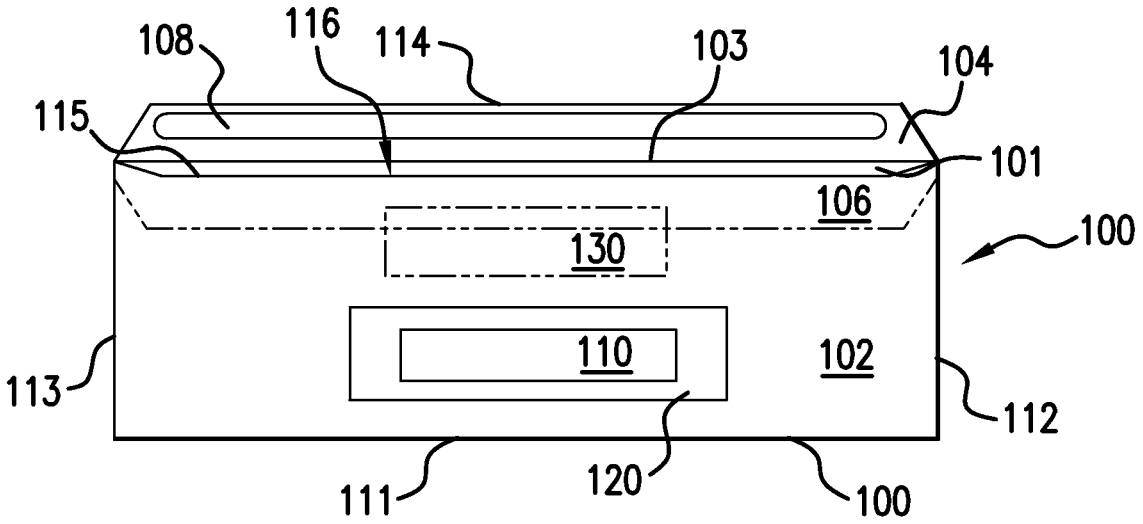
FIG. 1 is a view of an envelope with a removable sealing strip, according to an exemplary embodiment of the present invention.

Referring to FIG. 1, an exemplary embodiment can include an envelope 100. Envelopes can be formed, for example, from a blank that is folded and glued or otherwise affixed along certain edges (e.g., two or three out of four edges in a rectangular envelope). The blank can be die cut from a single sheet, and have at least two walls that define an inner pocket therebetween. For example, envelope 100 includes a first wall 101, which in this view is substantially hidden by second wall 102. From the perspective illustrated in FIG. 1, first wall 101 can be referred to as the front wall, and second wall 102 can be referred to as the back wall. First wall 101 can be connected to a sealing flap 104 via hinge 103. Hinge 103 can be a living hinge, and/or a fold of a continuous structure that forms both the sealing flap 104 and the first wall 101. Likewise, the second wall 102 can be a continuous structure with the first wall 101, via a hinge along bottom edge 111, while side edges 112 and 113 can be affixed together, e.g. via a permanent adhesive. The first and second walls 101 and 102, along with the sealed edges 111, 112, and 123 can define a pocket 115 and pocket opening 116.

Figure 2:
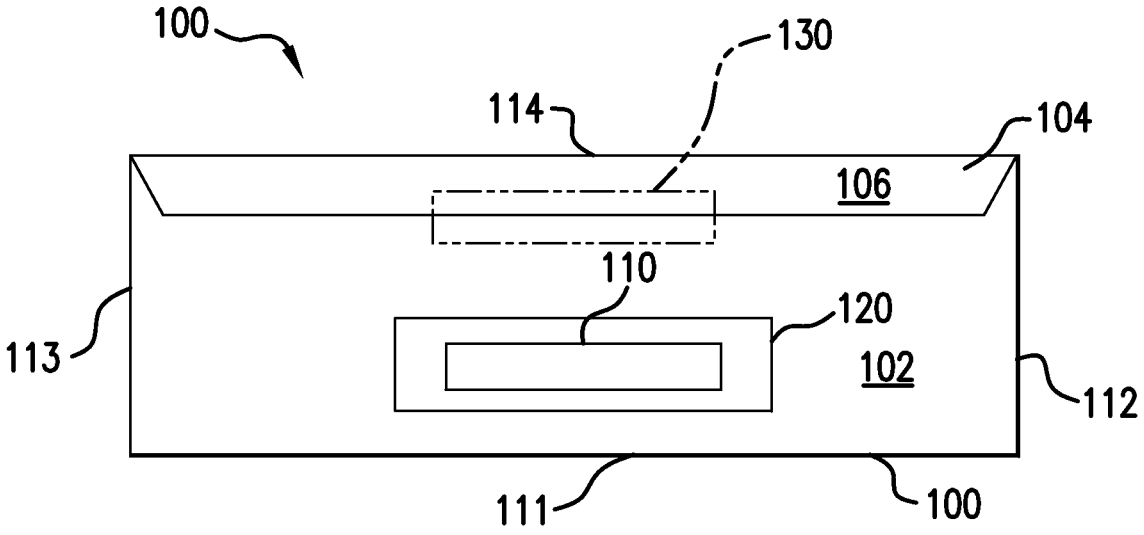
FIG. 2 is the same view of the envelope according to FIG. 1, with the closure flap illustrated in the closed position.

Sealing flap 104 can include a free edge 114 that defines a border line between the flap 104 and an adjacent portion of the second wall 102 while in the closed position. The sealing flap 104 can pivot (e.g., about 180° from alignment extending from the first wall to the closed position via hinge 103), into contact with an overlap area 106 of the second wall 102. Overlap area 106 is outlined with dashed lines in FIG. 1, while in FIG. 2 the sealing flap 104 has been pivoted into the closed position, coving overlap area 106. Once pivoted, the sealing flap 104 closes the opening 116. The closure flap 104 can include an adhesive layer 108, such as a moisture activated glue strip, an adhesive with a removable cover strip, or other suitable adhesive arrangement. Other variations are possible for other exemplary envelopes.

The envelope 100 includes a first location 120 with a sealing strip 110 temporarily or removably adhered thereto. The sealing strip 110 can be made from a single or multilayer film including plastic and/or paper material such as a plastic laminated paper film. The first location 120 is preferably located outside of the area of overlap 106 in a position different than the necessary position to seal the flap 104 to the second wall 102. Preferably, the sealing strip 110 in the first location 120 is positioned so that it needs to be completely removed from the envelope 100 and then repositioned over the flap 104 and second wall 102 in a second location 130 to seal the flap 104 in the closed position.

The sealing strip 110 can be removable from the first location 120, being detachable from the portion of the envelope 100 to which it is removably attached to in the first location 120, and placeable in a second location 130 overlapping the closure flap 104 in the closed position and an adjacent portion of the second wall 102. This second location 130 is illustrated with a dashed line in approximately the center of the overlap area 106 border, although alternatively the user can select another suitable placement for the second location 130. The second location 130 can include any suitable area, size, or orientation that overlaps the closure flap 104 in the closed position and an adjacent portion of the second wall 102.

The sealing strip 110 can include an adhesive capable of adhering to the closure flap 104 and the adjacent portion of the second wall 102 for securing the closure flap 104 in the closed position. This adhesive can cause a removable bond with the surface material at the first location 120 and a permanent or semi-permanent bond with the second location 130, in which the bond at the second location 130 is significantly stronger than with the surface at the first location 120. This can be accomplished in any number of ways. For example, the first location 120 can include a surface structure or material that causes the adhesive to form a tacky bond, while still being removable, and the second location 130 can include a surface structure or material that causes the same adhesive to form a more permanent bond. The second location 130 can be a paper-based material, or any other suitable material. The first location 120 can include a different a suitable material affixed to the envelope 100 surface, which can include a release layer or of a release material, which can be applied, for example, as a laminated layer, sprayed-on layer, or by another suitable process. The release layer can be provided, for example, with a tape having a non-stick or semi-stick surface, wax paper, sprayed on wax or other release layer, plastic, or other suitable materials. One embodiment can form envelope 100 in a pre-existing way, and then add (e.g., by machine automation) the semi-stick second area 120, e.g., by automated application of one or more tape strips or spray application of a wax material.

FIGS. 3A to 3E illustrate various exemplary embodiments of an adhesive strip arrangement that includes a release layer 320, and a sealing strip 351 having a grasping portion 340, a sealing portion 350, and a weakened region 345 connecting the grasping 340 and sealing 350 portions. The sealing strip 351 can be of similar construction to the sealing strip 110, described in FIGS. 1-2, but includes a grasping portion 340. The sealing portion 350 can include an adhesive layer permanently associated with the sealing strip 351. The sealing strip 351 can be releasably adhered to the release layer 320, e.g., at the sealing portion 350. The release layer 320 can be selected such that the adhesive layer of sealing portion 350 makes a temporary or otherwise removable bond with release layer 320. The release layer 320 can be directly on an envelope, or in other embodiments, on another structure, such as a base layer, or in yet other embodiments, can be separate from other structures.

The grasping portion 340 can be of the same or different material as sealing portion 350, and preferably is provided without the adhesive layer associated with sealing portion 350, or alternatively with a weaker adhesive or an arrangement of the adhesive that makes the grasping portion 340 easier to peel from the release layer 320 at the first location 120 than the sealing portion 350. Alternatively, the surface of the release layer 320 at first location 120 can be different under the grasping portion 340 than the sealing portion 350 to enable easier peeling away of the grasping portion 340. The grasping portion 340 can thereby be configured to provide a user a mechanism for removing the sealing portion 350 from the release layer 320. Connecting the grasping portion 340 and the sealing portion 350 can be a weakened area 349, which can be configured to facilitate a user removing grasping portion 340 from sealing portion 350 (e.g., after sealing portion 350 has been removed from release layer 320 and applied to a permanent location).

Figure 3A:
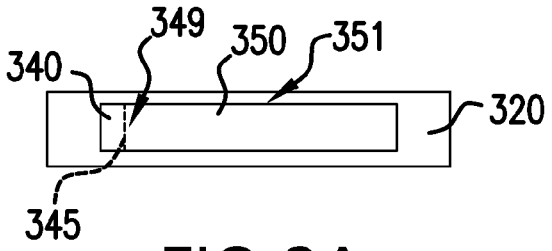
FIGS. 3A to 3E each include an exemplary removable sealing strip, with different exemplary weakened areas 39 attached an exemplary tear-off portion, according to other exemplary embodiments of the present disclosure.
Figure 3B:
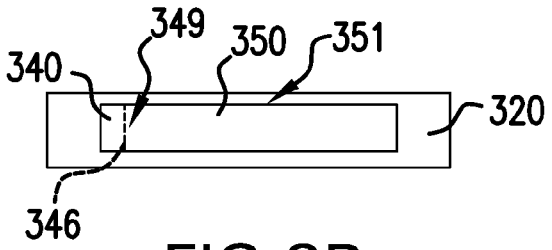
Figure 3C:
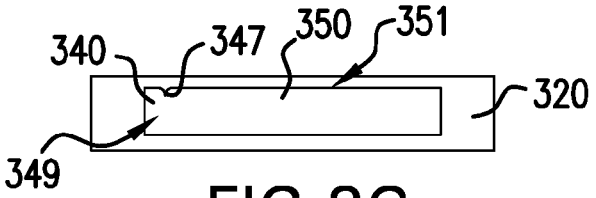
Figure 3D:
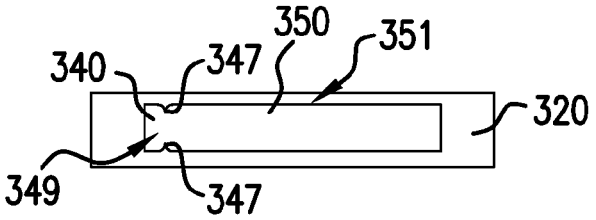
Figure 3E:
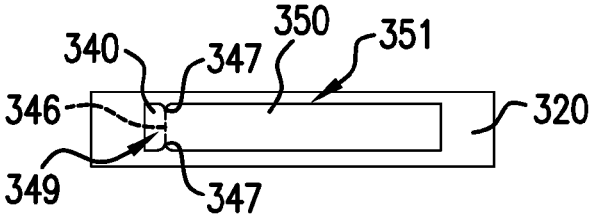

The weakened area 349 can be configured in a number of ways. FIG. 3A illustrates one exemplary embodiment of a perforation line 345, e.g., a repeating line of micro cuts configured to provide a weakened and severable bond between grasping 340 and sealing 350 portions. FIG. 3B illustrates another exemplary embodiment of a weakened area 349 configured with another perforation line 346. FIG. 3C illustrates another exemplary embodiment of a weakened area 349 including a cut out notch feature 347. This type of weakened area 349 can facilitate grasping portion 340 facilitating removal of sealing portion 350 from release layer 320 while being removable from the sealing portion 350. A notch feature 347, such as illustrated in FIG. 3C, can be configured to provide a strong bond between the grasping portion 340 and sealing portion 350 when pulled in certain directions (e.g., perpendicular to the plane of release layer 320 or toward the notch feature 347), while providing a weak or destroyable bond when pulled in other directions (e.g., away from the notch feature 347). FIG. 3D includes a notch feature 347 at both lateral sides of the sealing strip 351. FIG. 3E includes the exemplary notch features 347 at both lateral sides of the sealing strip 351, along with a perforation feature 346 between those notch features. While not illustrated, another exemplary weakened area 349 can include a single notch feature 347, such as illustrated in FIG. 3C, and a perforation feature, such as illustrated in FIG. 3E. These weakened areas 349, e.g., perforation lines 345 and 346, can be perpendicular to a longitudinal direction of the sealing strip 351, can be straight, curved, or angled, and preferably extends from one lateral side to another.

In conjunction with the relative weakened strength of the weakened areas 349, an adhesive layer applied to sealing portion 350 can be selected and configured such that the weakened area 349 provides a bond strong enough to remove sealing portion 350 from release layer 320 when pulling on grasping portion 340. In one embodiment, the grasping portion 340 can lack the adhesive layer associated with sealing portion 350 to facilitate removal by allowing a user to easily grasp the grasping portion 340 and pull the grasping portion 340 to remove the sealing portion 350 from the release layer 320. In another embodiment, the adhesive layer can be selected and configured such that when permanently adhered (e.g., to the flap and adjacent portion of the wall of an envelope), the adhesive bond is strong enough to hold the sealing portion 350 while the grasping portion 340 is removed (e.g., torn off of the adhesive strip arrangement).

The exemplary adhesive strip arrangement can be configured in any number of sizes, shapes, or materials. For example, the sealing strip 351 can be elongated in a longitudinal axis with a grasping portion 340 at a distal end, can be round with a protruding grasping portion, or can be another shape capable of overlapping two adjacent areas. The grasping portion 340 can be made from a continuous material with the sealing portion (and a weakened area therebetween), or can be made from one or more different materials. The grasping portion 340 should be large enough to allow a user to grasp it and remove the sealing portion 350, and can otherwise be other suitable sizes or shapes. For example, the grasping portion 340 can be one sixteenth of an inch to one quarter of an inch, or any other size, e.g., one eighth of an inch. The scaling portion 350 can be one half an inch or smaller to other suitable sizes able to fit within release layer 320, e.g., two to three inches.

Figure 4:
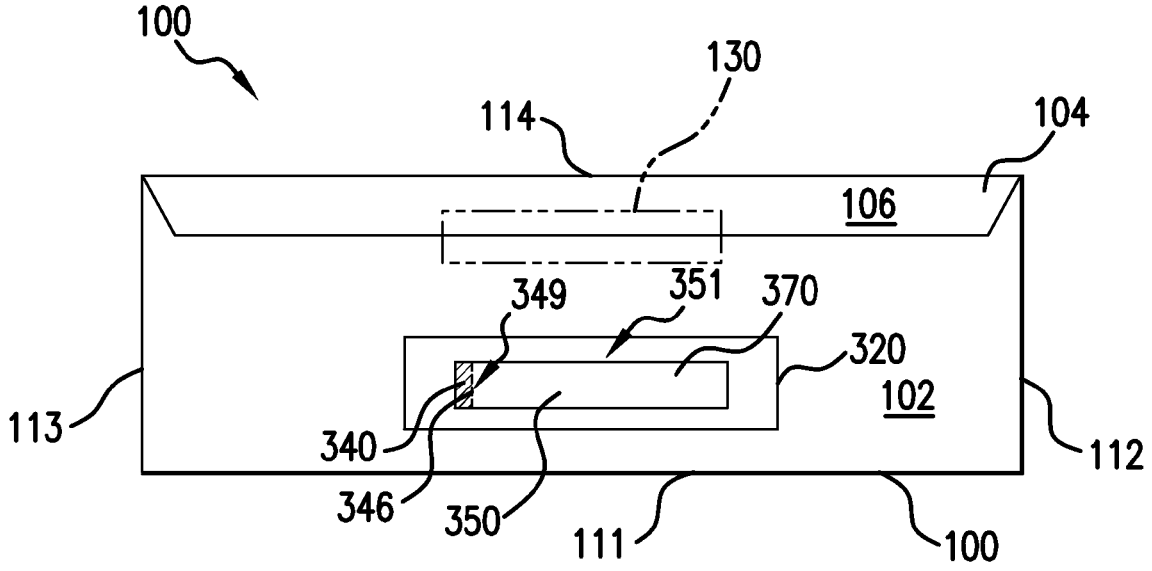
FIG. 4 is an exemplary envelope with a removable sealing strip, including a differently appearing grasping tip and printed indicia sealing portion, according to another exemplary embodiment of the present invention.

The grasping portion 340 can also be configured with a different appearance (e.g., color) or with printed instructions to remove and/or on how to remove the grasping portion 340. For example, FIG. 4 illustrates an exemplary embodiment of an exemplary envelope 100, with a release layer 320 and an sealing strip 351 with a sealing portion 350, weakened area 349, and grasping portion 340, which is shown with hashed lines to designate a separate color and/or appearance. The sealing portion 350 can also include printed indicia 370, such as a mailing address on the side obverse to the associated adhesive layer. Preprinted return addresses could be provided as sealing strip 110 or 351, a company logo, or any other printed indicia.

Figure 5:
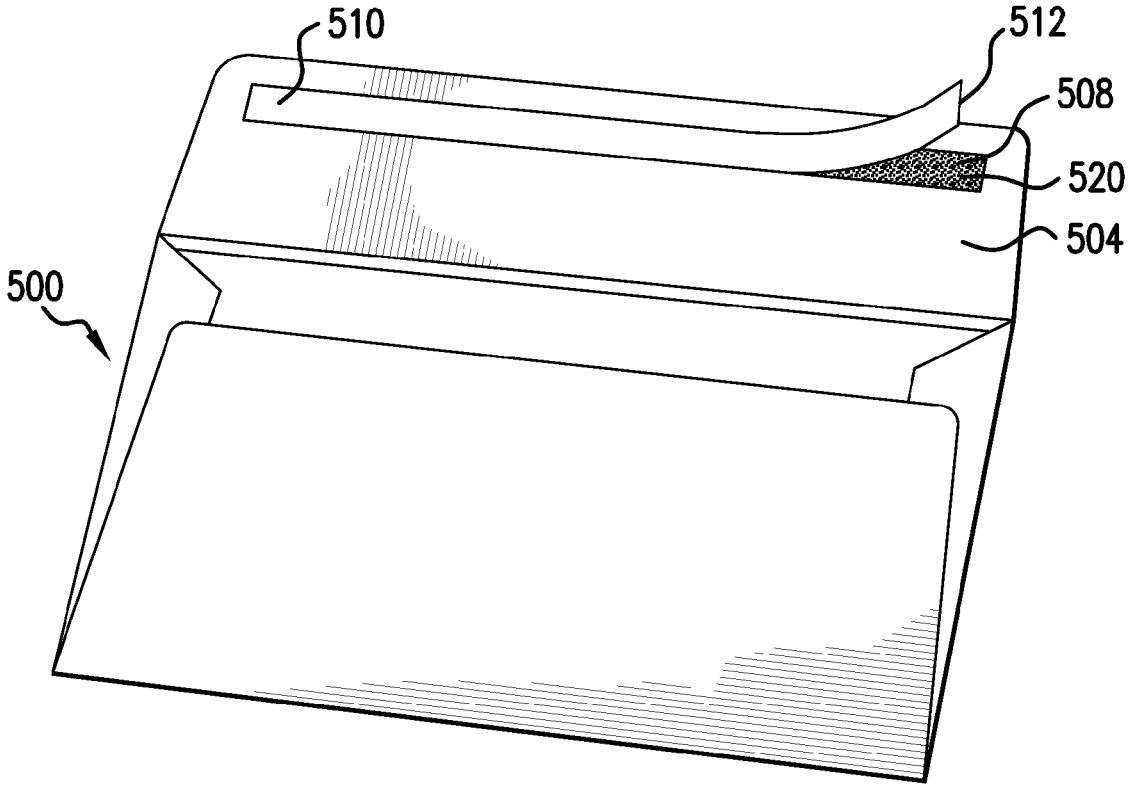
FIG. 5 is another exemplary envelope with a removable sealing strip.

FIG. 5 illustrates an exemplary envelope 500 having a flap adhesive 508. The flap adhesive 508 can be situated on the flap 504 for adhering to second wall 502 when the flap 504 is closed. The sealing strip 510 has its own layer of adhesive 512, which is releasably adhered to adhesive 508, preferably as a temporary (releasable) tacking adhesion. When positioned over adhesive 508, the sealing strip 510 can act as the protective strip to the flap adhesive 508. When the sealing strip 510 is removed from the flap adhesive 508, the sealing strip 510 has sufficient adhesive qualities to create a secure bond to a second area of the envelope. The flap adhesive 508 can be disposed directly on the flap 504 or on a base layer 520 which retains the flap adhesive 508 when the sealing strip 510 is peeled away therefrom. In FIG. 5, the sealing strip 510 is disposed in a first location on the inner surface of the flap 504 (based on the position of this surface when the flap is closed), and is not in a position from which it can be partially peeled and reattached to seal the flap 504 closed, although other embodiments can use other arrangements.

Figure 6:
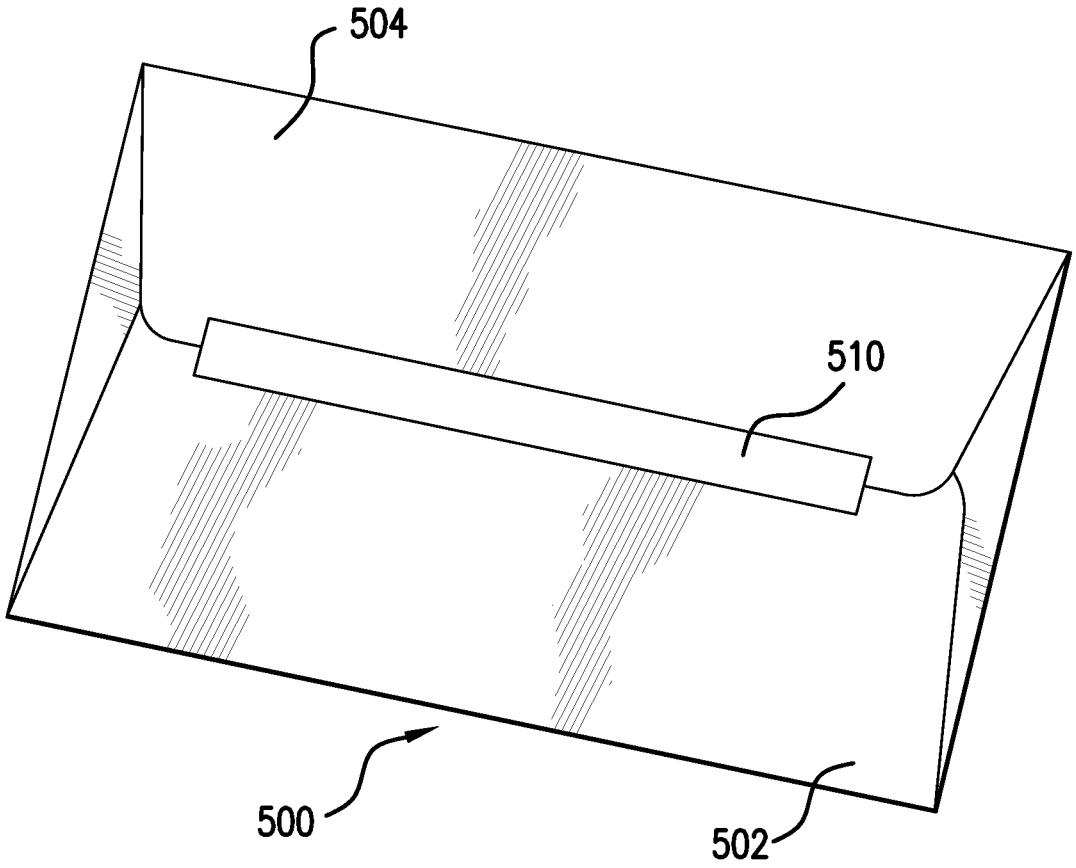
FIG. 6 is another view of the exemplary envelope of FIG. 5, with the exemplary envelope closed.

FIG. 6 illustrates a second area across the closed flap 504 and second wall 502 for receiving the sealing strip 510. One or more adhesives can be selected to ensure sealing strip 510 creates a removable bond with flap adhesive 508 while at the same time capable of forming a more permanent or permanent bond with other areas (e.g., the area of second wall 502 in alignment with closed flap adhesive 508, and any area of cross-over between flap 504 and second wall 502).

All of the references specifically identified in the detailed description section of the present application are expressly incorporated herein in their entirety by reference thereto. The term "about," as used herein, should generally be understood to refer to both the corresponding number and a range of numbers. Moreover, all numerical ranges herein should be understood to include each whole integer within the range. Moreover, various adhesives and/or bonds are described as temporary and/or permanent. These can relate to a general relative strength between the two, whether the bond would cause structural damage if removed, whether the adhesive can be reused after a previous use, or any number of other relative strength distinctions between permanent, semi-permanent, temporary, and/or removable. In the case of paper envelopes, a permanent adhesion would typically remove a layer of paper along with the strip as it is pulled off. References to more permanent adhesion indicates a noticeably stronger adhesion that a temporary adhesion. Also, exemplary envelopes can be of any size, shape, and/or material, including standards sizes configured to receive one or more standard sized papers, e.g., letter, legal, A4, etc.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. An envelope comprising:

first and second walls cooperatively enclosing a pocket space and defining therebetween an envelope opening to the pocket space;

a closure flap having a free edge with a first adhesive layer adjacent thereto, the closure flap being associated with the first wall and pivotable with respect thereto to a closed position, the free edge is to define a border line between the closure flap and an adjacent portion of the second wall in the closed position; and a sealing strip having a detachable grasping portion, a first side, and a second side with a second adhesive layer, wherein, in an unsealed position, the sealing strip is releasably adhered to the envelope in a first location, and wherein, in the closed position, the first adhesive layer is to adhere to the second wall to form a first seal between the closure flap and the second wall to close the envelope opening and secure the closure flap, and the sealing strip is placed at a second location of the envelope overlapping the closure flap and an adjacent portion of the second wall to form a second seal between the closure flap and the second wall to secure the closure flap, at least a portion of the second seal is to overlap at least a portion of the first seal, wherein the sealing strip includes a weakened region dividing the sealing strip into a sealing portion and the grasping portion, the weakened region includes a line of perforations to enable the sealing portion to disconnect from the grasping portion, the sealing portion includes the second adhesive layer, the line of perforations enables the weakened region to hold the sealing and grasping portions together when the sealing strip is removed from the first adhesive layer, the line of perforations enables the weakened region to disconnect the sealing portion from the grasping portion when the sealing portion is adhered to the second wall and the outer surface of the flap.

2. The envelope of claim 1, wherein the grasping portion of the sealing strip is free of the adhesive layer of the sealing strip.

3. An envelope comprising:

first and second walls cooperatively enclosing a pocket space and defining therebetween an envelope opening to the pocket space;

a closure flap having a free edge with a first adhesive layer adjacent thereto, the closure flap being associated with the first wall and pivotable with respect thereto to a closed position, the free edge is to define a border line between the closure flap and an adjacent portion of the second wall in the closed position; and a sealing strip having a detachable grasping portion, a first side, and a second side with a second adhesive layer, wherein, in an unsealed position, the sealing strip is releasably adhered to the envelope in a first location, and wherein, in the closed position, the first adhesive layer is to adhere to the second wall to form a first seal between the closure flap and the second wall to close the envelope opening and secure the closure, and the sealing strip is placed at a second location of the envelope overlapping the closure flap and an adjacent portion of the second wall to form a second seal between the closure flap and the second wall to secure the closure flap, at least a portion of the second seal is to overlap at least a portion of the first seal, wherein the sealing strip includes a weakened region dividing the sealing strip into a sealing portion and the grasping portion, the weakened region includes a line of perforations to enable the sealing portion to disconnect from the grasping portion, the sealing portion includes the second adhesive layer, wherein the weakened region, the sealing portion and the grasping portion are releasable together from the first adhesive layer as a single strip of tape by pulling on the grasping portion.

4. The envelope of claim 3, wherein the first location is disposed on the envelope such that the sealing strip must be moved away from the first location for securing the closure flap to the second wall in the second position.

5. The envelope of claim 3, wherein the second position crosses over the border line.

6. The envelope of claim 3, wherein the second adhesive is configured for permanently adhering to the second location.

7. The envelope of claim 3, further comprising a release layer on the first location configured for providing the releasable adhesion and allowing removal of the sealing strip.

8. The envelope of claim 3, wherein the sealing strip comprises a tape with a layer of the second adhesive.

9. The envelope of claim 3, wherein the weakened region is to facilitate manual separation of the sealing portion from the grasping portion.

10. The envelope of claim 3, wherein the line of perforations extends across the sealing strip.

11. The envelope of claim 3, wherein the grasping portion is smaller than the sealing portion.

12. The envelope of claim 3, wherein the sealing strip is elongated in a longitudinal axis, and the weakened region extends laterally across the sealing strip.

13. The envelope of claim 3, wherein the grasping portion includes instructions on how to disconnect the grasping portion from the sealing portion.

14. The envelope of claim 3, wherein the sealing portion includes printed indicia on the side opposite the adhesive layer.

15. The envelope of claim 14, wherein the printed indicia includes a postal address.

16. The envelope of claim 7, wherein the release layer includes a wax layer.

17. The envelope of claim 7, wherein the release layer is sprayed onto a base layer.

18. The envelope of claim 17, wherein the base layer and the second wall form different parts of a common substrate.

19. The envelope of claim 3, wherein the grasping portion extends from the sealing portion as an area of the sealing strip provided without the second adhesive layer associated with the sealing portion.

20. The envelope of claim 3, wherein the sealing strip fully separates from the envelope between being placed in the first location and the second location.

* * * * *